US011155374B2

(12) United States Patent
Thesing et al.

(10) Patent No.: US 11,155,374 B2
(45) Date of Patent: Oct. 26, 2021

(54) METHOD OF FORMING MULTI-COMPARTMENT TOBACCO POUCH

(71) Applicant: PHILIP MORRIS PRODUCTS S.A., Neuchatel (CH)

(72) Inventors: Onesio Luis Thesing, Ecublens (CH); Digvijay Singh, Pully (CH)

(73) Assignee: Philip Morris Products S.A., Neuchâtel (CH)

( * ) Notice: Subject to any disclaimer, the term of this patent is extended or adjusted under 35 U.S.C. 154(b) by 149 days.

(21) Appl. No.: 16/093,901

(22) PCT Filed: Mar. 8, 2017

(86) PCT No.: PCT/IB2017/051361
§ 371 (c)(1),
(2) Date: Oct. 15, 2018

(87) PCT Pub. No.: WO2017/187281
PCT Pub. Date: Nov. 2, 2017

(65) Prior Publication Data

US 2019/0084702 A1 Mar. 21, 2019

(30) Foreign Application Priority Data

Apr. 29, 2016 (EP) ..... 16167783

(51) Int. Cl.
*B65B 9/20* (2012.01)
*B65B 29/00* (2006.01)
(Continued)

(52) U.S. Cl.
CPC ..... *B65B 9/2056* (2013.01); *B65B 29/00* (2013.01); *A24B 3/00* (2013.01); *B65B 5/022* (2013.01);
(Continued)

(58) Field of Classification Search
CPC ..... B65B 9/2056; B65B 2220/14; B65B 2220/22; B65B 2230/02; B65D 81/3261; A24F 23/04; A24F 23/02
(Continued)

(56) References Cited

U.S. PATENT DOCUMENTS 2,160,367 A * 5/1939 Maxfield ..... B65B 9/213 53/433
2,514,255 A * 7/1950 Piazze ..... B65D 75/5805 206/264
(Continued)

FOREIGN PATENT DOCUMENTS

CN 2875969 3/2007
DE 19505880 A1 * 8/1996 ..... B65B 9/213
(Continued)

OTHER PUBLICATIONS

International Search Report and Written Opinion for PCT/IB2017/051361, prepared by the European Patent Office, dated May 24, 2017; 14 pgs.
(Continued)

*Primary Examiner* — Joshua G Kotis
(74) *Attorney, Agent, or Firm* — Mueting Raasch Group

(57) ABSTRACT

Methods of forming a tobacco pouch having two or more compartments are disclosed. The methods include forming a multi-compartment tobacco pouch with a vertical form fill seal machine.

16 Claims, 3 Drawing Sheets

(51) Int. Cl.
*A24B 3/00* (2006.01)
*B65B 5/02* (2006.01)

(52) U.S. Cl.
CPC ..... *B65B 2220/14* (2013.01); *B65B 2220/22* (2013.01); *B65B 2230/02* (2013.01)

(58) Field of Classification Search
USPC ..... 53/474, 445, 451, 551–552; 220/520; 383/38–40; 206/260
See application file for complete search history.

(56) References Cited

U.S. PATENT DOCUMENTS

| | | | | |
|---|---|---|---|---|
| 2,528,778 | A * | 11/1950 | Piazze | B65D 75/5855 206/274 |
| 2,826,025 | A * | 3/1958 | Swartz | B65B 61/02 53/554 |
| 3,394,870 | A * | 7/1968 | Curtis | B65D 77/08 206/94 |
| 3,749,620 | A | 7/1973 | Montgomery | |
| 4,402,402 | A | 9/1983 | Pike | |
| 5,832,698 | A | 11/1998 | Huguenin | |
| 6,488,146 | B1 * | 12/2002 | Dotsikas | A61J 7/0046 206/217 |
| 7,448,185 | B2 * | 11/2008 | Zeedyk | B65B 43/123 53/452 |
| 8,402,724 | B2 * | 3/2013 | Cecil | B29C 65/02 53/374.6 |
| 9,238,537 | B2 * | 1/2016 | Edwards | B65B 9/2056 |
| 9,957,075 | B2 * | 5/2018 | Garthaffner | B65B 9/2028 |
| 9,981,761 | B2 * | 5/2018 | Murray | B65B 9/2056 |
| 10,258,082 | B2 * | 4/2019 | Suss | B65D 33/2508 |
| 2003/0009989 | A1 * | 1/2003 | Knoerzer | B65B 9/20 53/451 |
| 2004/0040258 | A1 | 3/2004 | Sarria | |
| 2007/0127853 | A1 | 6/2007 | Bezek | |
| 2010/0142861 | A1 * | 6/2010 | Sam | B65D 75/527 383/38 |
| 2010/0272868 | A1 * | 10/2010 | Krysty | B65D 81/3266 426/120 |
| 2014/0361018 | A1 | 12/2014 | Edwards | |
| 2016/0150819 | A1 * | 6/2016 | McCormick | B29C 66/43 206/258 |

FOREIGN PATENT DOCUMENTS

| | | | | |
|---|---|---|---|---|
| EP | 0448440 | A1 * | 9/1991 | B65D 81/3261 |
| EP | 1913826 | B1 | 11/2010 | |
| EP | 2097320 | B1 | 4/2016 | |
| GB | 349970 | A | 6/1931 | |
| GB | 2208350 | A | 3/1989 | |
| NL | 8701152 | A | 12/1988 | |
| WO | WO 94/14676 | A1 | 7/1994 | |
| WO | WO 2011/080591 | A2 | 7/2011 | |
| WO | WO 2015/014704 | A1 | 2/2015 | |
| WO | WO-2015032594 | A2 * | 3/2015 | B65D 33/18 |

OTHER PUBLICATIONS

Extended European Search Report for EP 16167783.6, prepared by the European Patent Office, dated Nov. 7, 2016; 9 pgs.
Chinese First Office Action issued by the China National Intellectual Property Administration for CN 201780022930.9, dated Jun. 30, 2020: 20 pgs. including English Translation.
Chinese Third Office Action for CN 201780022930.9 issued by the China National Intellectual Property Administration, dated Jul. 22, 2021; 19 pgs.

* cited by examiner

METHOD OF FORMING MULTI-COMPARTMENT TOBACCO POUCH

This application is the § 371 U.S. National Stage of International Application No. PCT/IB2017/051361, filed 8 Mar. 2017, which claims the benefit of European Application No. 16167783.6, filed 29 Apr. 2016, the disclosures of which are incorporated by reference herein in their entireties.

BACKGROUND OF THE INVENTION

This disclosure relates to a method of forming a multi-compartment tobacco pouch, such as a tobacco pouch having a tobacco compartment and a tobacco accessory compartment.

Handmade cigarette are made, usually by the smoker, by wrapping a rectangular sheet of cigarette wrapping paper of the length of the cigarette around loose tobacco. Cigarette papers for hand making, having a moisture activated adhesive strip along one long edge, are usually presented in a small package of card from which one paper protrudes through a slot; the papers are folded longitudinally and interleaved inside the packet so that removal of the protruding paper causes the next paper to protrude through the slot. The wrapping may be done by hand or by use of a cigarette rolling mat or by use of a small hand operated machine. The cigarette may include a filter, or not, according to the smoker's preference.

Tobacco for handmade cigarettes is often supplied in pouches of a polymeric sheet material. Such pouches are typically formed of a single rectangular sheet of material, one end of which is folded back on itself and the overlying edge margins sealed together to form a container portion for holding tobacco; the remainder of the sheet provides a flap that can be folded over the opening of the container portion and adhered to the front wall of the container portion to close the pouch. Once the tobacco pouch is opened, the tobacco begins to lose moisture and dry out.

A consumer of 'roll your own' or 'make your own' cigarettes requires in addition to tobacco, cigarette papers and, optionally, filters. These may be carried separately from the tobacco, but this can be inconvenient and may result in one of the components being mislaid by the consumer. If papers or filters are placed in the pouch with the tobacco, they can become mixed up with the tobacco and may be hard to find when required. Also, the relatively high moisture level in tobacco can cause the papers to become damp and the adhesive may be activated so that the papers in the packet of papers adhere to one another, making them inconvenient or impossible to use.

Multi-compartment pouches are difficult to manufacture. The complexity of manufacture increases as the number of items or types of items increase per multi-compartment pouch.

It would be desirable to provide a method of forming and filling a multi-compartment tobacco pouch with tobacco and a tobacco accessory. The multi-compartment tobacco pouch may be formed and filled by the same machine in one continuous motion or intermittent motion either in a single track format or in a multiple track format. It would be desirable that this multi-compartment tobacco pouch have one or two or more tobacco compartments and at least one tobacco accessory compartment where each compartment may have a resealable access opening.

SUMMARY OF THE INVENTION

The method of forming a tobacco pouch includes providing a film tube, having a length extending along a machine direction and a width extending along a transverse direction, and sealing a bottom edge of the film tube with a first transverse heat seal and forming a first tobacco compartment with an first open end. Then the method includes filling the first tobacco compartment with an amount of tobacco and sealing the first open end with a second transverse heat seal to enclose the first tobacco compartment and form a second tobacco accessory compartment with a second open end. Then the method includes sealing the second open end with a third transverse heat seal to enclose the second tobacco accessory compartment and form a second tobacco accessory compartment being free of tobacco.

A method of forming a tobacco pouch also may include providing a film tube, having a length extending along a machine direction and a width extending along a transverse direction, and sealing a bottom edge of the film tube with a first transverse heat seal and forming a first tobacco compartment with an first open end. Then the method includes filling the first tobacco compartment with a first amount of tobacco and sealing the first open end with a second transverse heat seal to enclose the first tobacco compartment and form a second tobacco compartment with a second open end. Then the method includes filling the second tobacco compartment with a second amount of tobacco and sealing the second open end with a third transverse heat seal to enclose the second tobacco compartment and form a third tobacco accessory compartment with a third open end. Then the method includes sealing the third open end with a fourth transverse heat seal to enclose the third tobacco accessory compartment and form a third tobacco accessory compartment being free of tobacco.

Preferably the tobacco compartments and the tobacco accessory compartment include a reclosable or resealable access opening. Preferably the tobacco pouch is formed with a vertical form fill seal machine.

Utilizing a vertical form fill seal machine offers a number of advantages in the manufacture of the multi-compartment (and multi-component) tobacco pouch. The methods described herein simplify manufacture and reduces capital expenditure and production cost of these tobacco pouches. In addition, these methods provide design flexibility of the multi-compartment (and multi-component) tobacco pouch, by allowing variation in the size and component and number of compartments of the tobacco pouch. Thus, multiple flavours or blends of tobacco may be provided. Also, since the compartments are sealed, the consumer may open a first compartment and consume the tobacco therein, whereas the other tobacco compartments remain sealed and tobacco freshness is thus preserved. Also, these formed multi-compartment (and multi-component) tobacco pouches allow cigarette paper (also referred to as rolling paper) or filters or both to be carried in the pouch separately so that the tobacco is held separate from the cigarette papers or filters. This avoids the cigarette papers or filters from becoming mixed up with the tobacco and avoids moisture from the tobacco affecting the cigarette papers or filters.

The terms "upper," "lower," "side," "top," "bottom," and other terms used to describe relative positions of the components of packaging or a pouch. The terms "left" and "right" may be used with reference to side walls or edges of the packaging or a pouch when the packaging or a pouch is viewed from a front side. When describing packaging or a pouch according to the present invention, these terms are used irrespective of the orientation of the container being described.

The term "inner surface" refers to the surface of a component of the assembled packaging or a pouch that is facing towards the interior of the packaging or a pouch, for example towards the tobacco material.

The term "outer surface" refers to the surface of a component of the packaging or a pouch that opposes the "inner surface" of the packaging or a pouch. For example, the packaging or a pouch includes a front wall that includes an outer surface that opposes the inner surface forming one of the compartments of the pouch.

The term "reclosable" refers to both sealing or adhering or any other method for reversibly affixing the element described herein.

This disclosure relates to method of forming a multi-compartment (and multi-component) tobacco pouch. Two or more compartments may be serially formed in a film tube by applying a transverse heat seal and filling the compartment through its open end. The open end may then be sealed by applying a transverse heat seal and again filling the compartment through its open end. The film tube may be formed or provided along the machine direction. Preferably a vertical form fill seal machine is utilized in the methods described herein.

The multi-compartment (and multi-component) tobacco pouch may have any useful number of discrete and serially formed compartments. The multi-compartment tobacco pouch may have 2 or more compartments, 3 or more compartments, 4 or more compartments, 5 or more compartments, 6 or more compartments, 7 or more compartments, or 8 or more compartments. At least one compartment contains tobacco material and at least one compartment contains a tobacco accessory such as cigarette paper. Preferably the compartment that contains the tobacco accessory does not contain tobacco material or is free of tobacco material.

The multi-compartment tobacco pouch may include one tobacco material compartment and one tobacco accessory compartment. The multi-compartment tobacco pouch may include two tobacco material compartments and one tobacco accessory compartment. In another embodiment, the multi-compartment tobacco pouch may include two tobacco material compartments, or three, four, five or more tobacco material compartments without an accessory compartment. In further embodiments, the multi-compartment tobacco pouch may include more than two tobacco material compartments and a tobacco accessory compartment. The tobacco accessory compartment may form and end portion of the multi-compartment tobacco pouch or the tobacco accessory compartment may separate two tobacco material compartments.

The multi-compartment tobacco pouch may include compartments that have different sizes or define different volumes. For example, the tobacco material compartment may define a first volume and the tobacco accessory may define a second volume that is at least about 10% less than or at least about 20% less than or at least about 30% less than the first volume. In some embodiments, the tobacco material compartment may define a first volume and the tobacco accessory may define a second volume that is at least about 10% greater than or at least about 20% greater than or at least about 30% greater than the first volume.

The multi-compartment tobacco pouch may include two or more tobacco compartments. The two or more tobacco compartments may each define an equal or substantially equal volume. In some embodiments one of the tobacco compartments defines a first volume and another tobacco compartment may define a second volume that is at least about 10% less than or at least about 20% less than or at least about 30% less than the first volume.

The seals that define each compartment of the multi-compartment tobacco pouch may be formed by any useful method such as heat sealing, cold sealing or ultrasonic sealing. Heat sealing is preferred. These seals may be hermetic or airtight, or may be a non-hermetic seal. The non-hermetic seals may be sealed along at least 90% or at least 95% or at least 99% of the seal area. Airtight compartments may or may not be pasteurized.

The multi-compartment tobacco pouch may be formed of a flexible substrate material from a sheet of material. The sheet may be formed of any flexible material or combination of materials that is capable of being heat-sealed to form a permanent seal that may be airtight. Furthermore, the material should have sufficient moisture barrier properties to prevent loss of moisture from the tobacco or smokable material during storage or use and to prevent the ingress of water or vapour into the pouch. In addition, the material forming the pouch is preferably impermeable to microorganisms. The pouch may have regions that are transparent or opaque or be metallized or be entirely transparent or opaque or be metallized.

The multi-compartment tobacco pouch may be formed from a single layer material, or a laminate material, for example a metal and plastic laminate. Suitable materials include single layer materials like polyolefins such as polyesters, in particular, polyethylene, polypropylene, polyethylene terephthalate (PET), linear low-density polyethylene (LLDPE), high-density polyethylene (HDPE), ultra high-density polyethylene (UHDPE), orientated polypropylene (OPP), cast polypropylene (CPP), for example.

Other embodiments include multiple layer laminates, preferably double or triple layer laminates. The multilayer laminates preferably include at least one layer of polyethylene, metalized polyethylene, polyethylene terephthalate or metalized polyethylene terephthalate and other suitable laminates, e.g. cellulose-based laminates with limited water-vapour permeability. The water-vapour permeability is measured by the vapour-water transmission rate in accordance with ISO 2528: 1995. In a preferred embodiment, the vapour-water transmission rate is measured at 25 degrees Celsius and 60 percent relative humidity.

In a preferred embodiment, the vapour-water transmission rate is less than about 20 grams per square meter per 24 hours, preferably less than about 15 grams per square meter per 24 hours, further preferred less than about 10 grams per square meter per 24 hours, even more preferably less than about 8 grams per square meter per 24 hours, most preferably less than 15 about 6 grams per square meter per 24 hours. In some preferred embodiments, a single heat seal closes a side edge of the tobacco pouch. Preferably, the pouch is hermetically sealed, preferably using a heat sealing process.

Preferably the multi-compartment tobacco pouch is formed from a multiple layer laminate, preferably double or triple layer laminates. The multilayer laminates preferably include at least one layer of polyolefin such as, polyethylene, metalized polyethylene, polyethylene terephthalate or metalized polyethylene terephthalate or other suitable laminates, e.g. cellulose-based laminates with limited water-vapour permeability. Preferably heat sealing forms a hermetic seal.

Examples of two layer laminate sheet material includes independently selecting two layers of the following materials: polyethylene, polypropylene, polyethylene terephthalate (PET), orientated polypropylene (OPP), cast polypropylene (CPP), metallized cast polypropylene (Met CPP), and metallized polyethylene (Met PE) for example.

Examples of three layer laminate sheet material includes independently selecting three layers of the following materials: polyethylene, polypropylene, polyethylene terephthalate (PET), metallized polyethylene terephthalate (Met PET), orientated polypropylene (OPP), cast polypropylene (CPP), metallized cast polypropylene (Met CPP), and metallized polyethylene (Met PE) for example.

In some preferred embodiments the multi-compartment tobacco pouch is formed of a laminate sheet material formed of a layer of orientated polypropylene (OPP), polyethylene terephthalate (PET) optionally metallized polyethylene terephthalate (Met PET), and polyethylene.

In some embodiments the multi-compartment tobacco pouch is formed of PET having a sheet thickness in a range from about 10 microns to about 50 microns. One example of a suitable three-layer laminated sheet material for forming the pouch comprises a first layer of about 40 grams per square meter of paper, a second layer of metallized about 12 micron thick PET, and a third layer of about 60 micron thick low density polyethylene.

Preferably, each compartment of the multi-compartment tobacco pouch includes a reclosable or resealable access opening. The reclosable or resealable access opening may be resealable using a resealable or non-permanent adhesive along at least one edge of the reclosable or resealable access opening. The reclosable or resealable access opening may be laser cut or die cut into the material forming each compartment. The reclosable or resealable access opening may be formed prior to compartment formation or following compartment formation.

Each reclosable or resealable access opening may therefore be resealed or at least partially resealed between openings in order to retain the freshness of the tobacco material and in particular to maintain the moisture level of the tobacco material in the tobacco compartments and maintain the tobacco accessory in the tobacco accessory compartment. The reclosable or resealable access opening may also prevent the tobacco material or tobacco accessory from falling out of the package between uses.

The one or more tobacco compartments are suitable for a wide variety of tobacco or smokable materials including one or more tobacco types. The tobacco material may be in any suitable form and may include tobacco cut from tobacco leaves, reconstituted tobacco material, or both. The tobacco material typically has a cut width of between about 0.1 and about 0.9 millimetres, more preferably between about 0.3 and about 0.6 millimetres and may be pasteurized.

Preferably, the moisture content of the tobacco material within the pouch is between about 15 percent and about 22 percent by weight, more preferably between about 16 percent and about 20 percent by weight as measured two weeks after the filling of the multi-compartment tobacco pouch with the tobacco material. The amount of tobacco material in the tobacco compartment preferably has a weight of between about 10 grams and about 500 grams, more preferably between about 20 grams and about 60 grams.

When two or more tobacco compartments are present in the multi-compartment tobacco pouch, each tobacco compartment may contain the same or same type or same blend of tobacco, or each tobacco compartments may contain a different or a different type or different blend of tobacco. Each tobacco compartments may contain the same amount or tobacco, or a different amount of tobacco.

Multi-compartment tobacco pouches according to the invention may be of any convenient size. The width (transverse direction distance value) of the multi-compartment tobacco preferably is from about 70 millimetres to about 220 millimetres, more preferably from about 80 millimetres to about 180 millimetres, most preferably from about 100 millimetres to about 160 millimetres. The maximum depth of each compartment of the multi-compartment tobacco pouch preferably is at least about 50 millimetres, preferably at least about 60 millimetres, even more preferably at least about 70 millimetres. The total length (machine direction distance value) of the multi-compartment tobacco pouch preferably is from about 100 millimetres to about 600 millimetres, more preferably from about 200 millimetres to about 500 millimetres.

The tobacco accessory compartment may be any convenient size to contain cigarette paper and optionally filter elements. The length (machine direction distance value) of the tobacco accessory compartment may be equal to the length (machine direction distance value) of the tobacco compartment. In some embodiments the length (machine direction distance value) of the tobacco accessory compartment is less than the length (machine direction distance value) of the tobacco compartment.

The reclosable or resealable access opening (for each compartment) may have any useful width (transverse direction distance value). Preferably the reclosable or resealable access opening has a width that is in a range from about 50% to about 90% of the width (transverse direction distance value) of the respective compartment.

The reclosable or resealable access opening may include any useful resealable, reclosable or reusable closure material. The reclosable or resealable access opening may include an adhesive, magnetic, electrostatic or mechanical closure element. Mechanical closure elements include, for example, microstructure structure, hook and loop fastener. Preferably the reclosable or resealable access opening forms a "peelable" seal where a consumer may gain access to each sealed compartment and reseal the access opening between uses.

The reclosable or resealable access opening may also include the e-close system, where the reclosable element is part of the laminate and is first opened with laser scoring.

Preferably the reclosable or resealable access opening may reseal or reclose the compartment at least about 5 times or at least about 10 times, or at least about 20 times or at least about 30 times. The term "reseal" refers to securely closing the reclosable or resealable access opening so that human force is required to peal open the reclosable or resealable access opening and allow a user to gain access to the tobacco or tobacco accessory. The reclosable or resealable access opening may therefore be resealed or at least partially resealed between openings in order to retain the freshness of the tobacco and tobacco paper and filters. The reclosable or resealable access opening may also prevent the tobacco and paper or filters from falling out of the compartments between uses. The reclosable or resealable access opening also reduces or prevents moisture from transmitting through the reclosable or resealable access opening when the reclosable or resealable access opening is in the closed or sealed position.

In many embodiments the reclosable or resealable access opening includes a pressure sensitive adhesive. A pressure sensitive adhesive is an adhesive forms a bond when pressure is applied to marry the adhesive with the adherend. Solvent, water, or heat is not needed to activate the adhesive. Pressure sensitive adhesives (PSAs) are known to possess properties such as: (1) aggressive tack at room temperature, (2) adherence to a substrate with no more than finger pressure, (3) sufficient ability to hold onto an adherend, and/or (4) sufficient cohesive strength to be removed cleanly from the adherend. Furthermore, the pressure sensitive adhesive may be a single adhesive or a combination of two or more pressure sensitive adhesives. Pressure sensitive adhesives are usually based on an elastomer that may be compounded with a tackifier. Useful elastomers include acrylics, rubbers, styrene block copolymers or vinyl ethers, for example. Pressure sensitive adhesives are commercially available from 3M Company, St. Paul, Minn.

In some embodiments, the reclosable or resealable access opening includes a low tack adhesive comprising a fast-curing acrylic oligomer (epoxidized soy bean oil acrylate), a slower-curing, reactive tack-control agent (urethane acrylate) and an optional elastomeric component (methacrylated polybutylene), commercially available from Mondelez International, for example.

In some embodiments the reclosable or resealable access opening includes a microsuction structure. The term "microsuction structure" is used herein to refer to an element comprising a flexible material having a plurality of micro cavities, microsuction cups or microbubbles on the material's external surface. The walls of the microsuction structure are deformable, such that, when the external surface of the material is pressed against a contact surface, a sealed environment of reduced pressure is formed between the walls of the cavities and the contact surface. This provides a suction force between the walls of the cavities and the contact surface. The microsuction structure may have a diameter of from about 5 microns to about 300 microns. The material may be formed of an expanded resin having a plurality of internal air bubbles. The material may be provided as a layer of a sheet-like article on the surface of the container. The layer may have a thickness of from about 30 microns to about 500 microns. The microsuction structure may be any microstructure that utilizes suction to form a seal. When the reclosable or resealable access opening is a microsuction structure, a removable liner may be disposed on the microsuction structure to protect the microsuction structure until the removable liner is removed by the consumer. The liner may be any useful liner such as a polymer or film material. Microsuction structures are commercially available under the trade designation YUPO TAKO from Yupo Europe GmbH.

In further embodiments, the reclosable or resealable access opening includes a magnetic material and an opposing magnetic material. The magnetic material may be one or more magnets forming the closure element. In preferred magnetic embodiments, the closure element is magnetic nanoparticles dispersed in a polymeric material. The polymeric material preferably is a light or heat curable polymeric adhesive. The magnetic nanoparticles preferably are magnetic metal or magnetic metal oxide nanoparticles. The magnetic metal includes iron, cobalt, nickel and alloys of iron, cobalt or nickel. The size of the nanoparticles is about 1 nanometer to about 100 nanometres.

In other embodiments, the reclosable or resealable access opening includes a hook and loop fastener. Hook and loop fasteners are commercially available under the trade designation VELCRO from Velcro GmbH.

The reclosable or resealable access opening may include a sealing element. The sealing element may be a zip element (such as a Zip-Lock element).

The multi-compartment tobacco pouch is advantageously formed utilizing a vertical form fill seal machine. A continuous film tube may be supplied to the vertical form fill seal machine or the vertical form fill seal machine may form the film tube from a continuous layer of film material.

The film tube may have a seal that extends in the machine direction that may be formed by the vertical form fill seal machine. The film tube may have a second seal that extends in the machine direction that may be formed by the vertical form fill seal machine, thus forming opposing left and right sides of the eventual tobacco pouch. The vertical form fill seal machine may form and fill the plurality of compartments of the multi-compartment tobacco pouch serially in the machine direction. These machine direction seals may be lap seals or fin seals. That may be formed by ultrasonic welding or cold sealing or heat sealing. These seals are preferably formed by heat sealing. These seals may or may not be hermetic or air tight.

Utilizing a vertical form fill seal machine offers a number of advantages in the manufacture of the multi-compartment (and multi-component) tobacco pouch, described herein. The vertical form fill seal machine forms these multi-compartment (and multi-component) tobacco pouches in a continuous manner while utilizing a relatively simple manufacturing apparatus. In addition, the design and configuration of the multi-compartment (and multi-component) tobacco pouch may be easily changed without substantially the physical vertical form fill seal machine. A variety of multi-compartment tobacco pouches may be formed and filled by the same machine in one continuous motion or intermittent motion either in a single track format or in a multiple track format of the same vertical form fill seal machine.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

BRIEF DESCRIPTION OF THE DRAWINGS

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure. Referring now to the drawings, in which some aspects of the present invention are illustrated.

DETAILED DESCRIPTION OF THE INVENTION

Figure 1:
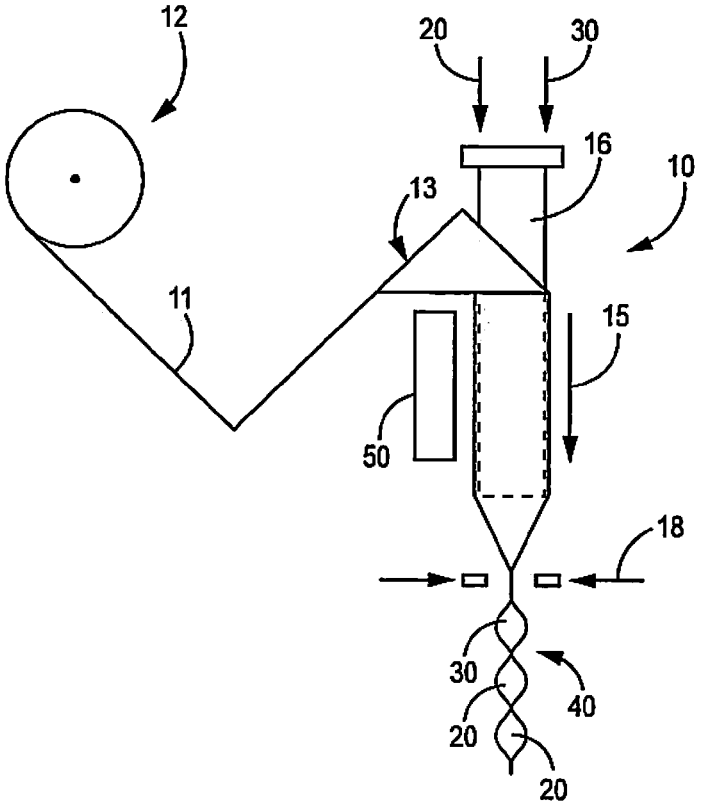
FIG. 1 illustrates a schematic diagram of a vertical form fill seal machine.

FIG. 1 is a schematic diagram of illustrative vertical form fill seal machine 10. A film layer or preformed film tube 11 may be supplied from a roll 12 to a shaping element or collar 13. The shaping element 13 disposes the film about the fill tube 16. In the case of a film layer 11 being provided to the shaping element or collar 13, a longitudinal heating element 50 seals the film layer to form a film tube. The seal may be a fin seal or a lap seal. The film tube 11 travels in the machine direction as indicated by the arrows 15 along the vertical form fill seal machine fill tube 16. A transverse or horizontal sealing element 18 forms a transverse seal to the film tube to form the compartments of the multi-compartment tobacco pouch 40. FIG. 1 illustrates a multi-compartment tobacco pouch 40 having three compartments, where the first two contain a first material 20 and the last one contains a second material 30. It is understood that the multi-compartment tobacco pouch 40 may have fewer or more compartments, as desired.

The film layer or film tube 11 may or may not be patterned prior to being applied to the shaping element 13. A cutting element may separate the multi-compartment tobacco pouch 40 from the continuous film tube 11 following formation of the multi-compartment tobacco pouch 40.

FIGS. 2A-2F illustrate one exemplary method of forming the multi-compartment tobacco pouch 40 utilizing the vertical form fill seal machine (not shown for clarity). It is understood that while a discrete length (or machine direction distance value) is illustrated, a continuous length of film would be moving through the vertical form fill seal machine and a dicing or cutting element would separate the multi-compartment tobacco pouch 40 from the continuous length of film (as illustrated in FIG. 1). The illustrated distinct length of film for FIGS. 2A-2F is utilized for clarity.

Figure 2A:
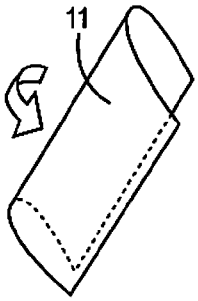
FIGS. 2A-2F illustrate one exemplary method of forming the multi-compartment tobacco pouch.
Figure 2B:
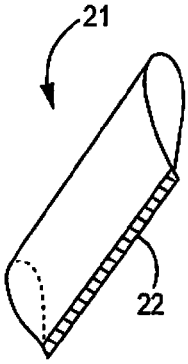

FIG. 2A illustrates providing a sheet (typically continuous) of film 11 that may be folded onto itself to form the film tube 21. A seal or seam 22 may be formed along the machine direction of the film 11 to form the tube 21 as shown in FIG. 2B.

Figure 2C:
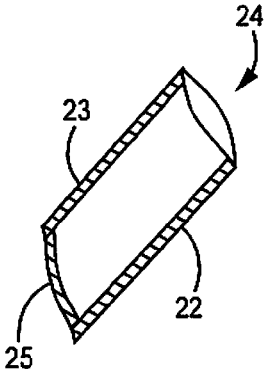

FIG. 2C illustrates a second seal or seam 23 opposing the seal or seam 22 may be formed along the machine direction of the film 11 to form the tube 21. A bottom transverse seal 25 may be formed along the bottom edge of the film tube 21. The film tube 21 defines an open first or top end 24.

Figure 2D:
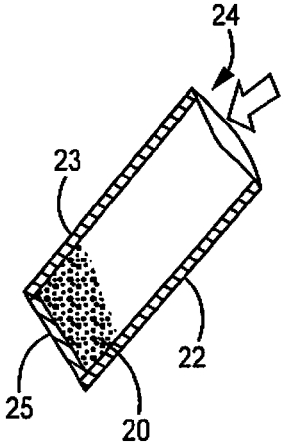
Figure 2E:
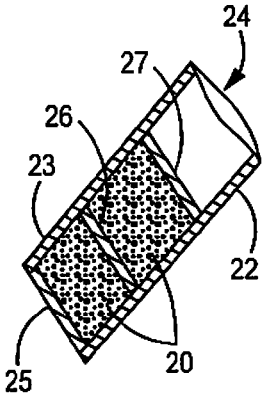

A first material 20 such as tobacco or a tobacco accessory may enter the open first or top end 24 as shown by the arrow in FIG. 2D. A second transverse seal 26 is formed to create a first compartment 41 (such as a tobacco compartment). A first material 20 or a second material 30 may then be filled into the top end 24 and a third transverse seal 27 is formed to create a second compartment 41 (such as a tobacco compartment or a tobacco accessory compartment) as shown in FIG. 2E.

Figure 2F:
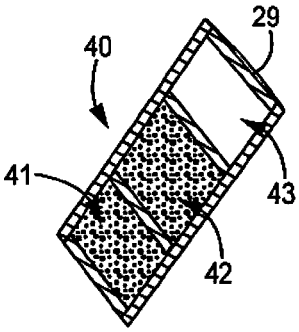

FIG. 2F illustrates the formation of a third compartment 43 by applying third transverse seal 26 to the top end 24. In one embodiment the first compartment 41 contains tobacco material, the second compartment 42 contains tobacco material (same or different type of tobacco or tobacco blend than the first compartment), and the third compartment 43 contains a tobacco accessory, such as cigarette paper. The tobacco accessory may be placed into the third compartment 43 within the vertical form fill seal machine or after the formation of the multi-compartment tobacco pouch 40.

Figure 3:
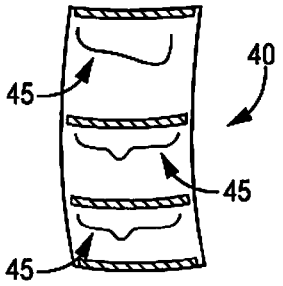
FIG. 3 illustrates a reclosable access opening.
Figure 4A:
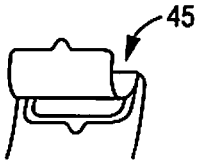
FIGS. 4A-4B illustrates a reclosable access opening.
Figure 4B:
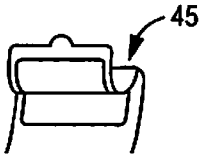

FIG. 3 and FIG. 4A and FIG. 4B illustrate reclosable access opening 45. The reclosable access opening 45 may be present on the film 11 prior to being processed by the vertical form fill seal machine or the reclosable access opening 45 may be applied to the multi-compartment tobacco pouch 40 following the formation of the compartments 41, 42, 43. The reclosable access opening 45 may be formed with a laser or die cut device.

Figure 5:
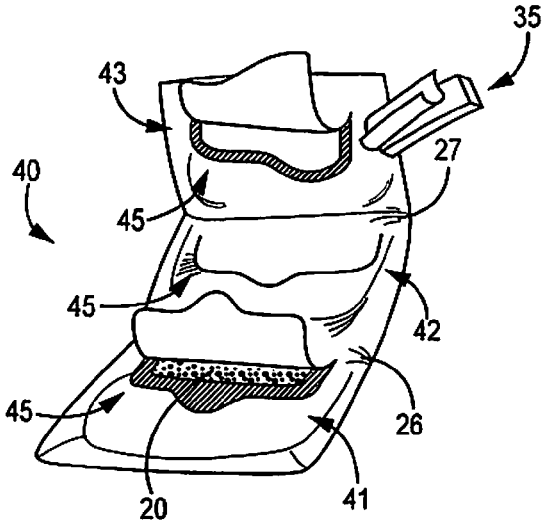
FIG. 5 illustrates a multi-compartment tobacco pouch.

FIG. 5 shows a multi-compartment tobacco pouch 40 with a first compartment 41 access opening 45 open and exposing tobacco material 20, and a second compartment 42 with a sealed access opening 45 and a third compartment 43 access opening 45 open and a tobacco accessory 35 being placed into the third compartment 43.

Figure 6:
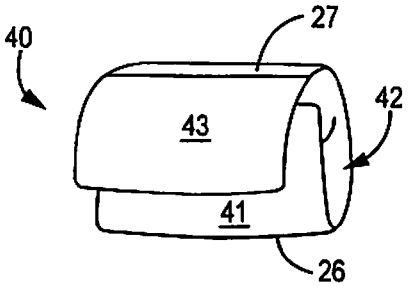
FIG. 6 illustrates a multi-compartment tobacco pouch.

FIG. 6 illustrates a multi-compartment tobacco pouch 40 folded onto itself. The first compartment 41 is folded (along or adjacent to the second transverse seal 26) onto the second compartment 42, and the third compartment 43 is folded (along or adjacent to the third transverse seal 27) onto the first compartment 41.

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A method of forming a multi-compartment pouch with a vertical form fill seal machine, comprising:

providing a film tube having a length extending along a machine direction and a width extending along a transverse direction;

sealing a bottom edge of the film tube with a first transverse heat seal and forming a first tobacco compartment;

filling the first tobacco compartment with an amount of tobacco;

sealing the first tobacco compartment at a first position along the length of the film tube at a first distance from the bottom edge with a second transverse heat seal to enclose the first tobacco compartment forming a first side comprising a first portion of the film tube and a second, opposing side comprising a second portion of the film tube and forming a second tobacco accessory compartment;

sealing the second tobacco accessory compartment at a second position along the length of the film tube at a second distance from the bottom edge, the second distance being greater than the first distance, with a third transverse heat seal to enclose the second tobacco accessory compartment forming a first side comprising a third portion of the film tube and a second, opposing side comprising a fourth portion of the film tube and wherein the enclosed second tobacco accessory compartment being free of tobacco;

disposing a tobacco accessory within the second tobacco accessory compartment prior to the sealing of the second tobacco accessory compartment with the third transverse heat seal; and forming a reclosable access opening in one of the first and second sides of at least one of the first and second compartments, wherein the reclosable access opening comprises a foldable flap.

2. The method of claim 1, wherein the forming a reclosable access opening includes forming a reclosable access opening in the first tobacco compartment.

3. The method of claim 1, wherein the forming a reclosable access opening includes forming a reclosable access opening in the second tobacco accessory compartment and disposing a tobacco accessory within the second tobacco accessory compartment.

4. The method of claim 3, wherein the forming a reclosable access opening includes forming a reclosable access opening in the first tobacco compartment.

5. The method of claim 1, wherein the forming a reclosable access opening includes forming a reclosable access opening in the first tobacco compartment.

6. The method of claim 1, further comprising folding the second tobacco accessory compartment onto the first tobacco compartment and about the second transverse heat seal.

7. The method of claim 1, wherein the second tobacco accessory compartment is configured to contain cigarette paper.

8. A method of forming a multi-compartment pouch with a vertical form fill seal machine, comprising:

providing a film tube having a length extending along a machine direction and a width extending along a transverse direction;

sealing a bottom edge of the film tube with a first transverse heat seal and forming a first tobacco compartment;

filling the first tobacco compartment with a first amount of tobacco;

sealing the first tobacco compartment at a first position along the length of the film tube at a first distance from the bottom edge with a second transverse heat seal to enclose the first tobacco compartment forming a first side comprising a first portion of the film tube and a second, opposing side comprising a second portion of the film tube and forming a second tobacco compartment;

filling the second tobacco compartment with a second amount of tobacco;

sealing the second tobacco compartment at a second position along the length of the film tube at a second distance from the bottom edge, the second distance being greater than the first distance, with a third transverse heat seal to enclose the second tobacco compartment forming a first side comprising a third portion of the film tube and a second, opposing side comprising a fourth portion of the film tube and forming a third tobacco accessory compartment;

sealing the third tobacco accessory compartment at a third position along the length of the film tube at a third distance from the bottom edge, the third distance being greater than the second distance, with a fourth transverse heat seal to enclose the third tobacco accessory compartment forming a first side comprising a fifth portion of the film tube and a second, opposing side comprising a sixth portion of the film tube and wherein the third tobacco accessory compartment is free of tobacco;

disposing a tobacco accessory within the third tobacco accessory compartment prior to the sealing of the third tobacco accessory compartment with the fourth transverse heat seal; and forming a reclosable access opening in one of the first and second sides of at least one of the first, second, and third compartments, wherein the reclosable access opening comprises a foldable flap.

9. The method of claim 8, wherein the forming a reclosable access opening includes forming a reclosable access opening in the third tobacco accessory compartment and disposing a tobacco accessory within the third tobacco accessory compartment.

10. The method of claim 8, wherein the forming a reclosable access opening includes forming a reclosable access opening in the first tobacco compartment and the second tobacco compartment.

11. The method of claim 8, wherein the forming a reclosable access opening includes forming a reclosable access opening in the third tobacco accessory compartment and disposing a tobacco accessory within the third tobacco accessory compartment.

12. The method of claim 11, wherein the forming a reclosable access opening includes forming a reclosable access opening in the first tobacco compartment and the second tobacco compartment.

13. The method of claim 8, wherein the forming a reclosable access opening includes forming a reclosable access opening in the first tobacco compartment and the second tobacco compartment.

14. The method of claim 8, further comprising folding the first tobacco compartment onto the second tobacco compartment and folding the third tobacco accessory compartment onto the first tobacco compartment.

15. The method of claim 8, wherein the first amount of tobacco is a different tobacco or tobacco blend than the second amount of tobacco.

16. The method of claim 8, wherein the third tobacco accessory compartment is configured to contain cigarette paper.

* * * * *